US005518086A

United States Patent [19]

Tyni

[11] Patent Number: 5,518,086

[45] Date of Patent: May 21, 1996

[54] PROCEDURE AND APPARATUS FOR THE CONTROL OF ELEVATOR DOORS

[75] Inventor: Tapio Tyni, Hyvinkää , Finland

[73] Assignee: Kone Elevator GmbH, Baar, Switzerland

[21] Appl. No.: 283,908

[22] Filed: Aug. 4, 1994

Related U.S. Application Data

[63] Continuation of Ser. No. 69,414, Jun. 1, 1993, abandoned.

[30] Foreign Application Priority Data

Jun. 1, 1992 [FI] Finland ..... 922529

[51] Int. Cl.[6] ..... B66B 13/14; B66B 1/34

[52] U.S. Cl. ..... 187/316; 187/392; 187/901

[58] Field of Search ..... 187/384, 392, 187/316, 317, 901

[56] References Cited

U.S. PATENT DOCUMENTS

| | | | |
|---|---|---|---|
| Re. 25,665 | 10/1964 | Nikazy | 187/103 |
| 2,838,136 | 6/1958 | Nikazy | 187/29 |
| 2,902,117 | 9/1959 | Pierson | 187/103 |
| 3,367,450 | 2/1968 | Lester et al. | 187/52 |
| 4,491,199 | 1/1985 | Shea et al. . | |
| 4,537,287 | 8/1985 | Noda et al. | 187/126 |
| 4,662,479 | 5/1987 | Tsuji et al. | 187/131 |
| 4,951,786 | 8/1990 | Haraguchi . | |
| 5,073,867 | 12/1991 | Murphy et al. | 395/27 |
| 5,260,527 | 11/1993 | Sraig, Jr. | 187/131 |
| 5,284,225 | 2/1994 | Platt | 187/51 |
| 5,387,768 | 2/1995 | Izard et al. | 187/392 |

FOREIGN PATENT DOCUMENTS

| | | | |
|---|---|---|---|
| 0452130 | 10/1991 | European Pat. Off. . | |
| 904941 | 8/1990 | Finland . | |
| 1-03185 | 8/1989 | Japan | 187/124 |
| 3-267288 | 11/1991 | Japan | 187/316 |
| 2243906 | 11/1991 | United Kingdom . | |

*Primary Examiner*—Robert Nappi

[57] ABSTRACT

A method and apparatus for controlling doors of an elevator includes a passenger sensor and load sensor. The passenger sensor detects the presence of passengers in a lobby, and the load sensor generates a load signal indicating only a load of the elevator. A processor then determines passenger movements between the lobby and the elevator, and passenger movements within the elevator based on the load signal. Next, an elevator door controller controls the elevator doors based on output from the processor and the passenger sensor.

15 Claims, 2 Drawing Sheets

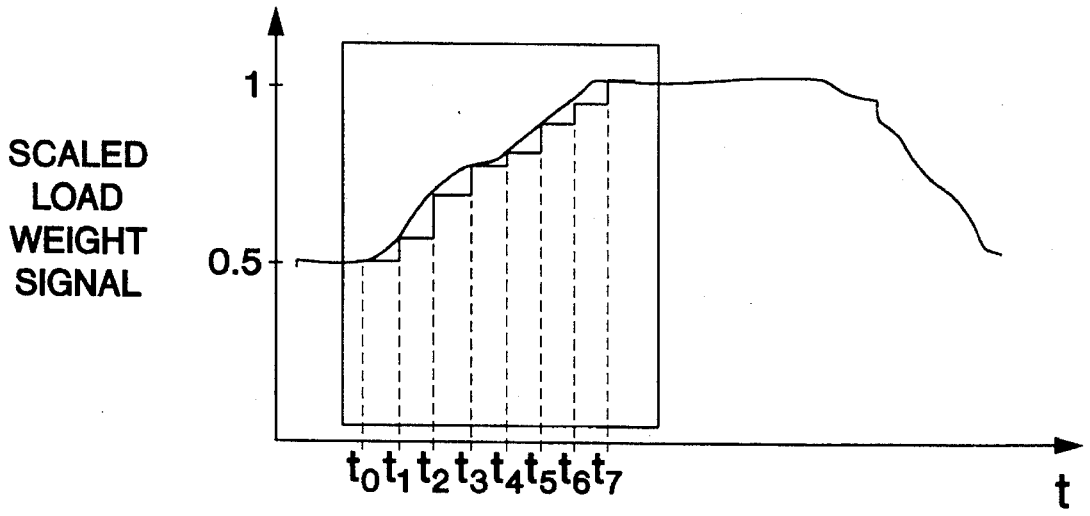
FIG. 2
FIG. 3
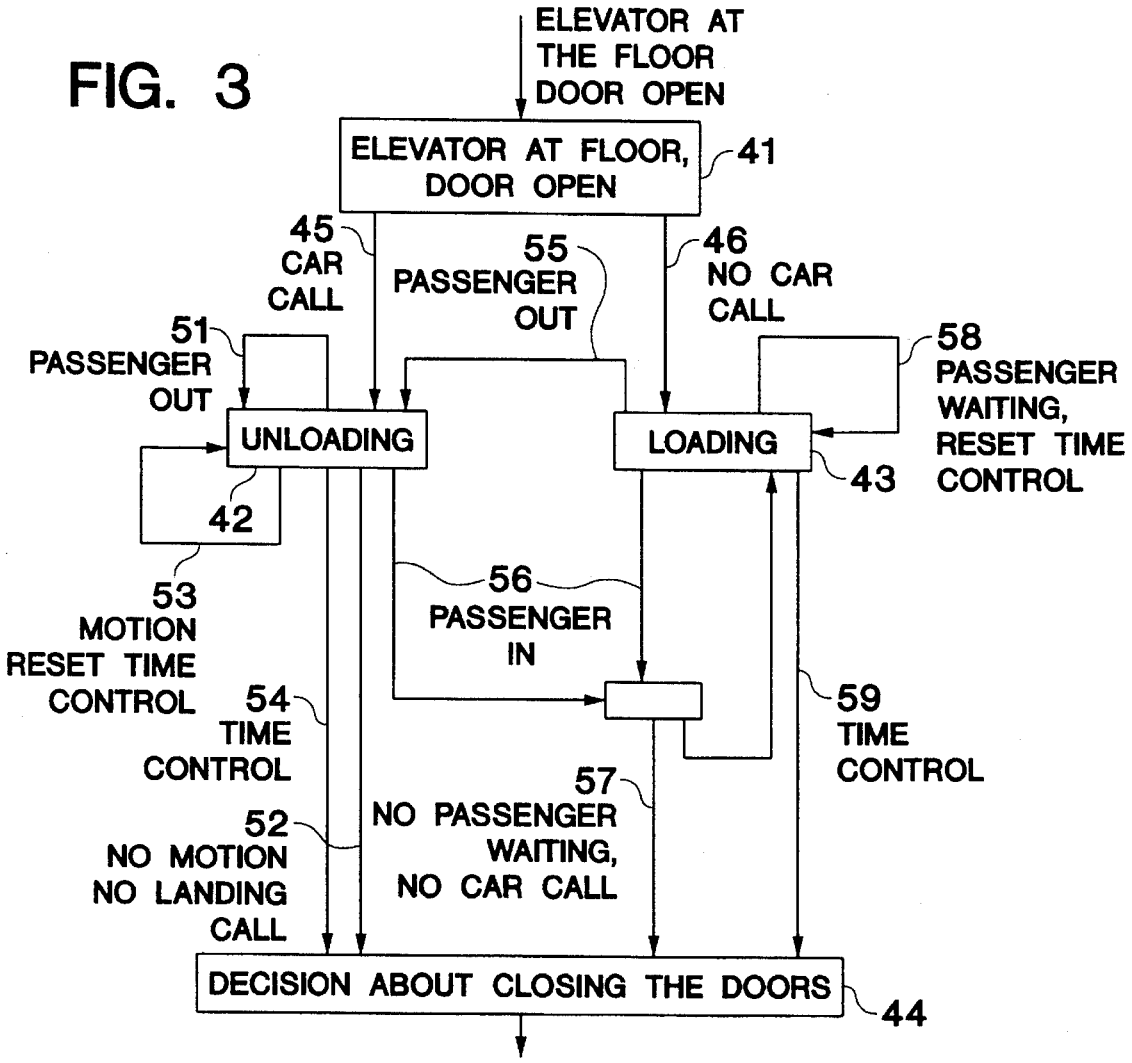

PROCEDURE AND APPARATUS FOR THE CONTROL OF ELEVATOR DOORS

This application is a continuation, of application Ser. No. 08/069,414 filed on Jun. 1, 1993, now abandoned.

BACKGROUND OF THE INVENTION

The present invention relates to a procedure and an apparatus for the control of elevator doors.

The function of an elevator is to provide a certain transport capacity for the transportation of passengers between the floors of a building. The capacity should be as high as possible. It depends on the number, dimensions and travelling speed of the elevator cars. For the transport capacity to be efficiently exploited, the time the elevator spends standing at a floor should be as short as possible, i.e. only as long as is necessary to allow the passengers to leave the car and new passengers to enter. All time in excess of this is dead time, during which the elevator cannot move and no passengers are entering or leaving the car.

The operation of the door control system is of great importance in the utilization of the transport capacity, because the better the door control procedure, the sooner the doors can be closed after the last passenger has entered/left the car and the more effectively is the transport capacity of the elevator utilized. On the other hand, if the doors are closed too soon, a passenger may be caught between the doors. In principle, this involves no danger, because the safety circuits will reopen the doors. However, this is an unpleasant experience for the passenger, and it also means wasting time as it disturbs the normal movement of passengers and reopening the door takes its own time.

In a previously known procedure, the movement of a passenger into or out of an elevator car is detected by means of a light beam passing between the door posts. When the passage of a passenger into or out of the car is detected from an interrupted light beam, the door is kept open for a certain delay in case another passenger should follow. This system has obvious drawbacks: the delay is dead time and should therefore be minimized. However, the delay cannot be shortened without limit because the behaviour of the door would then become aggressive as the door would tend to close too soon, jamming the next potential passenger in the doorway. The method is a mixture of a real time procedure and a statistical one: the passengers are observed in real time but the action (delay) triggered by them contains an implicit idea of normal passage of passengers and a normal preset mean distance between them during the movement.

Publication EP A2 452 130 presents a procedure whereby the door-open time is estimated on the basis of history data. The operation is based on counting and keeping floor-specific statistics of the numbers of passengers entering and leaving the elevator car. The history data are used for the determination of the door-open time for each hour of the day. As the procedure depends heavily on statistics, it cannot take the momentary situation prevailing around the door into account.

SUMMARY OF THE INVENTION

The object of the present invention is to create a new procedure for the control of elevator doors which enables the transport capacity of the elevator to be utilized as efficiently as possible while minimizing the delays in the closing of the doors.

The invention provides a truthful real-time picture of the situation regarding the loading and unloading of the elevator car, enabling the system to close the doors as soon as it perceives that all those who wanted to enter/leave the car have done so. According to the invention, the presence of passengers in the lobby and their passage from the lobby into the car and vice versa as well as their movements in the car are continuously observed. This information is used as a basis for real-time data about the movements of passengers in the doorway and in its vicinity. In the procedure of the invention, there is no use for the concept of 'door-open time' and no open time need be determined in the control of the doors, because the doors are closed as soon as the passenger situation on the floor in question and in the elevator car allows it.

BRIEF DESCRIPTION OF THE DRAWINGS

In the following, the invention is described in detail by the aid of an example by referring to the attached drawings, in which

FIG. 2 illustrates the measurement of the load signal.

FIG. 3 is a diagram of the states in the decision-making process of the procedure of the invention.

FIG. 1 is a perspective view of an elevator car 1 and related equipment, essential to the operation of the invention, mounted in the car or connected to it via signal conductors. The elevator car 1 is moved along an elevator shaft by means of a rope 23. Fitted in the front wall of the elevator car is a sliding door 2, through which the passengers move from the car into the elevator lobby when the elevator has stopped at a floor. The door is provided with a conventional light cell 24 and safety edges, which, upon detecting an obstacle in the path of the door, produce an instruction to open the door. The elevator car is provided with a lobby detector 4, which is mounted above the door in the middle of the doorway and recognizes a passenger waiting for the elevator. The lobby detector 4 may be implemented e.g. in the manner known from patent FI C 70651 (Int. CI. G 06 K 9/28) and acts as a sensor indicating the presence of passengers. It detects any passengers present within the area 5 in front of the door and produces a corresponding signal containing first passenger data, which is passed via a signal connection 11 to a door control computer 21.

Figure 1:
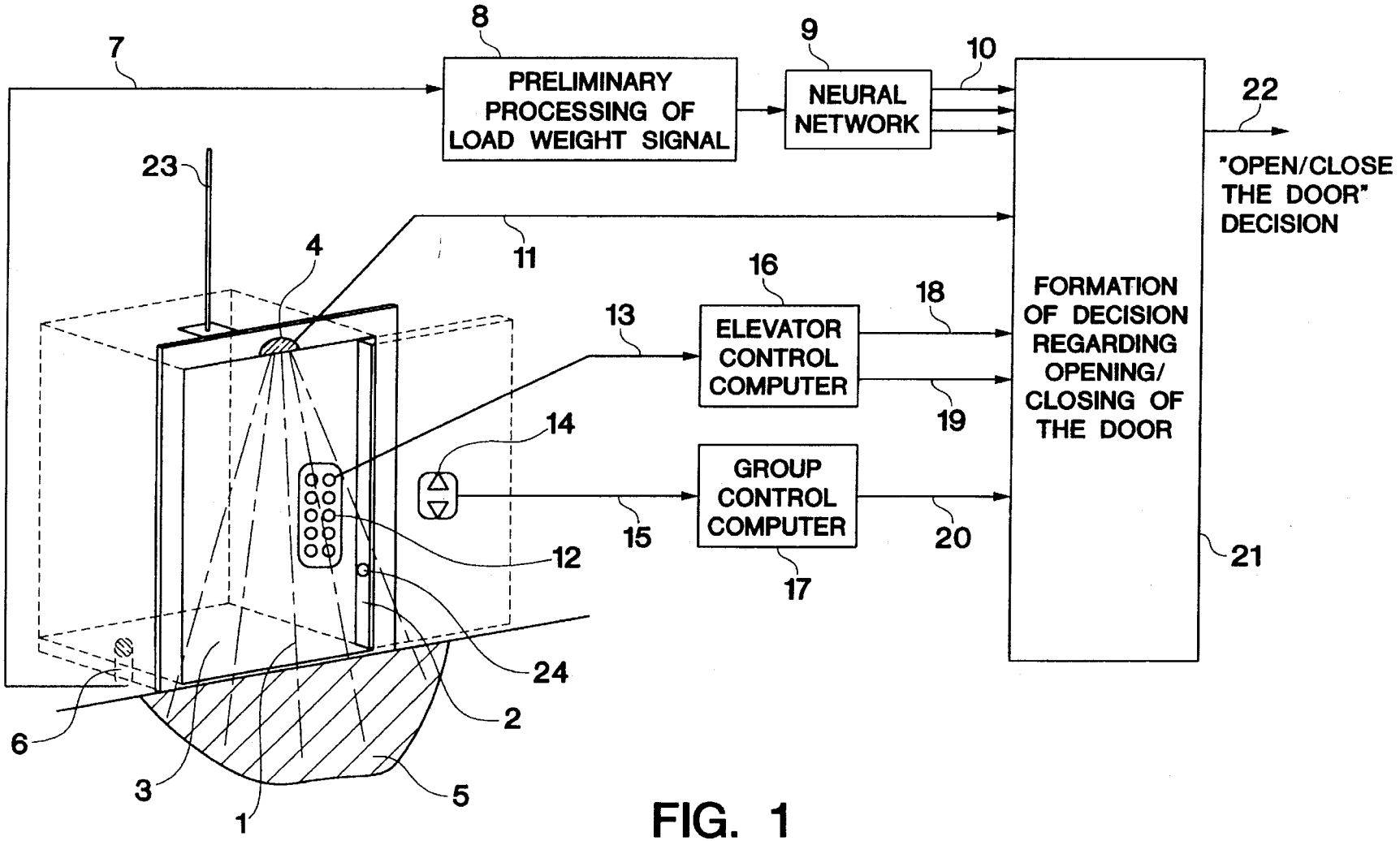
FIG. 1 is a diagram of the apparatus of the invention.

Placed under the car is a load-weighing device 6 which measures the magnitude and variations of the load. The load weighing device consists of a scale placed under the floor of the car and measuring the car load only, or a sensor placed in the car frame and measuring the weight of the whole car. Alternatively, the scale can also be placed elsewhere in the car frame or in the supporting structure, not necessarily under car. These various weighing devices are known in themselves in elevator technology and need not be discussed further. The signal obtained from the load weighing device shows stepwise changes caused by passengers entering or leaving the car. Similarly, it shows the changes resulting from the steps taken by passengers in the car. The solution of the invention is designed to recognize these changes. Since the car hangs suspended from ropes in the shaft, its mass together with the elasticity of the ropes constitutes a mechanical resonance circuit. The change in resonance circuit energy resulting from the movements of the passengers excites the system to vibrate at its own resonant frequency. These vibrations are also transmitted to the weight signal, making it fairly difficult to distinguish the desired events by conventional algorithmic methods. For this reason, the signal obtained from the load weighing device is passed via a signal conductor 7 to a filtering and processing device 8 performing a preliminary processing, and further to a neural network 9.

In addition to filtering the signal, the filtering and processing device 8 shifts the reference level of the signal according to the prevailing situation. FIG. 2 presents an example of the load weight signal and of how it is processed to enable the desired information to be obtained through the neural network 9. As shown in FIG. 2, the load weight signal is observed as a separate window. The window includes 8 signal values taken at equal intervals. The signal is so scaled that the first value of each window occurs at the middle of the window (i.e., scale to a value of 0.5 as shown on the vertical axis of FIG. 2), so that the window has room for the changes resulting from the movement of a passenger. The signal values inside the window under consideration are applied to the inputs of the neural network 9. During the teaching of the network, the interconnections between the neurons of the network are assigned values such that certain input signals correspond to a given output signal 10 representing passenger movement: passenger in, passenger out, or passenger moving inside car. Thus, the network output signal provides real-time second and third data representing the movement of passengers between the car and the elevator lobby, and a fourth data representing the movement of a passenger inside the car. The output signal of the neural network is taken via connections 10 into the door control computer 21, where it is used in the formation of the decision regarding the closing of the door.

In the above, the detector indicating the passage of a passenger into/out of the car and the motion detector substantially consist of the same apparatus. However, these devices can also be implemented separately. According to an embodiment of the invention, the occurrences of a passenger moving between the car and the lobby are detected by means of a weighing device placed on the landing in front of the elevator door. By suitably analyzing the signal obtained from this weigher, the occurrences of a passenger moving in or out can be determined.

The elevator car is provided with call buttons 12, by means of which the passenger selects his/her target floor. The call signal is passed via connection 13 to the elevator control computer 16, whose outputs inform the door control computer 21 via connections 18 and 19 as to whether the elevator is at the floor in question or whether a car call to that floor has been issued. Similarly, by pressing the call button 14 at the landing, a passenger waiting for an elevator gives a landing call, which is passed via conductor 15 to the group control computer 17, which informs the door control computer 21 via connection 20 about the landing call issued from that floor. The door control computer 21 forms a decision and transmits it via its output 22 to the door actuator.

The elevator control system has been described above on a general level. Many details and practical implementations may vary greatly depending on the application, without affecting the present invention.

The diagram of elevator states presented in FIG. 3 shows how the door control computer 21 makes a decision on the basis of the information supplied to it. Under the control of the elevator control system, the elevator arrives at a landing and the doors are opened. The elevator is now in a starting situation as represented by block 41. If a car call is in effect, the system proceeds to the unload state, block 42, as indicated by arrow 45. If no car call is present, the system proceeds via arrow 46 to the load state 46, block 43. It is assumed that the passengers leaving the car come out first and the new passengers enter after that, although this is irrelevant to the invention. In block 42, the car call is considered via loop 51 as reset when one passenger moves out of the car, this information being obtained from the output 10 of the neural network. If no movement is detected in the car and no landing call is in effect, the system proceeds via arrow 52 to block 44, i.e. decides to close the door. In addition, the system employs a time control procedure according to which it decides to close the door if no movement occurs in the car. If motion occurs, however, then the time period of the time period control is reset as shown by arrow 53. Typically, such a situation arises when a passenger has pressed the wrong button in the car.

From the load state 43 the system proceeds to the unload state 42 when a passenger steps out (arrow 55) of the car, and the possible car call is reset at the same time. A passenger entering the car resets the landing call, arrow 56, and if there are no passengers waiting in the lobby and no car call to the floor is in effect, arrow 57, the system decides to close the door, block 44. The time control procedure closes the door if no passenger is detected in the lobby within a certain time (arrows 54 and 59), e.g. because the person who pressed the landing call button has left the lobby. The time control procedure is reset when motion within the elevator is detected (arrow 53), or when a passenger is waiting in the lobby (arrow 58).

As mentioned in connection with FIG. 1, the door system of an elevator also includes a light cell and safety edges, which prevent the closing of the door when a passenger is in the doorway. Moreover, the system is provided with manual door opening and closing buttons. However, these devices produce high-priority signals that bypass the decisions of the system of the present invention and they can be connected to the logic circuitry after the system of the invention, e.g. near the door actuator.

In the above, the invention has been described in reference to one of its preferred embodiments. However, the presentation is not to be regarded as constituting a limitation of the sphere of protection of the invention, but the embodiments of the invention may vary within the limits defined by the following claims.

I claim:

1. A method of controlling elevator doors for an elevator, said method comprising the steps of:

(a) detecting the presence of passengers in a lobby;

(b) detecting only a total load of passengers in said elevator and producing a total load signal;

(c) processing only the total load signal from said step (b) to determine passenger movements between said lobby and said elevator, and passenger movements within said elevator; and (d) determining the control of said elevator doors based on output of said steps (a) and (c).

2. The method of claim 1, wherein said step (b) generates the total load signal representing said total load using a weight sensor.

3. The method of claim 2, wherein said step (c) comprises the steps of:

(c1) preprocessing said load signal to convert said load signal into a data format acceptable to a neural network; and (c2) applying said output of said step (c1) to a neural network, the output of which indicates whether a passenger enters said elevator, leaves said elevator, and said passenger movements within said elevator.

4. The method of claim 3, wherein said step (c1) comprises the steps of:

(c11) filtering said load signal; and (c12) shifting a reference level of said load signal.

5. The method of claim 1, wherein, when said elevator doors are open, said step (d) comprises the steps of:

(d1) entering a loading mode when a car call signal is not received from call means in said elevator;

(d2) entering an unloading mode when said car call signal is received from said call means in said elevator; in said loading mode, (d11) setting a first period, (d12) resetting said first time period when output of said step (a) indicates the presence of a passenger in the lobby, and (d13) determining to close said elevator doors when said first time period expires; and in said unloading mode, (d21) setting a second time period, (d22) resetting said second time period when output of said step (c) indicates said passenger movements within said elevator, and (d23) determining to close said elevator doors when said second time period expires.

6. The method of claim 5, wherein said loading mode of step (d) further includes the step of (d14) switching from said loading mode to said unloading mode when said output from said step (c) indicates that a passenger leaves said elevator.

7. The method of claim 5, wherein said step (d) further comprises the steps of:

in said loading mode, (d14) determining whether to close said elevator doors based on output from said step (a) when said step (c) determines that a passenger moves from said lobby to said elevator, and wherein said step (d11) sets said first time period when said step (c) does not determine that a passenger moves from said lobby to said elevator; and in said unloading mode, (d24) determining whether to close said elevator doors based on output from said step (a) when said step (c) determines that a passenger moves from said lobby to said elevator, (d25) determining to close said elevator doors when said step (a) fails to detect the presence of a passenger and said step (c) indicates no said passenger movements within said elevator; and wherein said step (d21) sets said second time period when said step (c) does not determine that a passenger moves from said lobby to said elevator.

8. A control apparatus for doors of an elevator, comprising:

a passenger sensor detecting the presence of passengers in a lobby;

a load sensor generating a load signal indicating only a total load of passengers in said elevator;

a processor determining passenger movements between said lobby and said elevator, and passenger movements within said elevator based only on said load signal; and an elevator door controller controlling said elevator doors based on output from said processor and said passenger sensor.

9. The apparatus of claim 8, wherein said processor comprises:

a preprocessor preprocessing said load signal to convert said load signal into a data format acceptable to a neural network; and a neural network operating on output from said preprocessor to determine whether a passenger enters said elevator, leaves said elevator, and said passenger movements within said elevator.

10. The apparatus of claim 8, wherein, when said elevator doors are open, said controller enters a loading mode when a car call signal is not received from call means in said elevator and entering an unloading mode when said car call signal is received from said call means in said elevator, said controller in said loading mode, sets a first time period, resets said first time period when output of said passenger sensor indicates the presence of a passenger in the lobby, and determines to close said elevator doors when said first time period expires; and in said unloading mode, sets a second time period, resets said second time period when said processor indicates said passenger movements within said elevator, and determines to close said elevator doors when said second time period expires.

11. The apparatus of claim 10, wherein said controller switches from said loading mode to said unloading mode when output of said processor indicates that a passenger leaves said elevator.

12. The apparatus of claim 11, wherein said controller in said loading mode, sets said first time period when said processor does not determine that a passenger moves from said lobby to said elevator, and determines whether to close said elevator doors based on output from said passenger sensor when said processor determines that a passenger moves from said lobby to said elevator;

in said unloading mode, sets said second time period when said processor does not determine that a passenger moves from said lobby to said elevator, determines whether to close said elevator doors based on output from said passenger sensor when said processor determines that a passenger moves from said lobby to said elevator, and determines to close said elevator doors when said passenger sensor fails to detect the presence of a passenger and said processor indicates no said passenger movements within said elevator.

13. The method of claim 1, wherein said step (b) generates the total load signal representing only a weight of all passengers in said elevator.

14. The apparatus of claim 8, wherein said load sensor is a scale disposed under the floor of the elevator.

15. The apparatus of claim 8, wherein said load sensor is a sensor placed in a frame of said elevator and measures a weight of said elevator.

* * * * *